US005475185A

United States Patent [19]

Tokarsky

[11] Patent Number: 5,475,185

[45] Date of Patent: Dec. 12, 1995

[54] SHIELDED CABLE

[75] Inventor: Edward W. Tokarsky, Newark, Del.

[73] Assignee: E. I. Du Pont de Nemours and Company, Wilmington, Del.

[21] Appl. No.: 861,992

[22] Filed: Apr. 1, 1992

[51] Int. Cl.[6] ..... H01B 7/34

[52] U.S. Cl. ..... 174/36; 174/34; 174/107; 174/109

[58] Field of Search ..... 174/32, 34, 36, 174/107, 109

[56] References Cited

U.S. PATENT DOCUMENTS

| | | | |
|---|---|---|---|
| 4,301,428 | 11/1981 | Mayer | 333/12 |
| 4,408,089 | 10/1983 | Nixon | 174/34 |
| 4,506,235 | 3/1985 | Mayer | 333/12 |
| 4,634,805 | 1/1987 | Orban | 174/128 R |
| 4,684,762 | 8/1987 | Gladfelter | 174/36 |
| 4,822,950 | 4/1989 | Schmitt | 174/36 |
| 4,897,301 | 1/1990 | Uno et al. | 174/254 X |
| 4,920,233 | 4/1990 | Kincaid | 174/36 |
| 4,960,965 | 10/1990 | Redmon et al. | 174/102 R |
| 5,073,440 | 12/1991 | Lee | 428/224 |
| 5,103,067 | 4/1992 | Aldissi | 174/36 |
| 5,248,554 | 9/1993 | Hsu | 428/395 |
| 5,298,028 | 3/1994 | Hsu | 8/130.1 |
| 5,302,415 | 4/1994 | Gabara et al. | 427/306 |
| 5,370,934 | 12/1994 | Burch et al. | 428/378 |

FOREIGN PATENT DOCUMENTS

| | | |
|---|---|---|
| 1019727 | 11/1957 | Germany . |
| 2622297 | 12/1977 | Germany . |
| 53-40886 | 4/1978 | Japan . |
| 999545 | 7/1965 | United Kingdom . |

*Primary Examiner*—Morris H. Nimmo

[57] ABSTRACT

A shielded cable is disclosed having metal coated aramid fibers as the shielding.

3 Claims, 4 Drawing Sheets

SHIELDED CABLE

BACKGROUND OF THE INVENTION

1. Field of the Invention

This invention relates to shielded cable, and more particularly to shielded cable that is lighter in weight than conventional shielded cable articles.

2. Discussion of Related Art

U.S. Pat. No. 4,634,805, issued Jan. 6, 1987, teaches coating fibers with metal, and braiding those fibers into a cable article. The use of metallic coated fibers is not taught in that patent for the purpose of fabricating shielded cable.

SUMMARY OF THE INVENTION

In accordance with the present invention, there is provided a shielded cable article comprising an inner conductive core of at least one wire that can be twisted or braided, and which can be individually insulated. The conductive core is surrounded by at least one layer of insulation about which a layer of shield material is applied to form a protective shield layer. The shield material comprises a braided or served mesh or woven yarn of metallically coated aramid fibers. The fibers of the yarn or mesh are characterized by high tensile strength and flexibility. Where the aramid fibers themselves are braided, the resulting braid can be applied more tightly about the interior insulation surface than can conventional metallic braids.

Aramid fibers of high tensile strength permit use of low denier yarns, whereby a greater shield weight reduction can be realized. The metal coating on the aramid fibers is in a thickness range about 0.05 to 5 microns.

Aramid yarns of 10 to 1500 denier can be used to form the shielding layer at a coverage in excess of 60% of the insulation layer. Individual fibers in the aramid yarns can be from 1 to 5 denier per filament.

A thin insulative jacket can be disposed over the protective shield layer to complete the shielded cable article of this invention.

The shielding effectiveness (operational frequency range) of the cable article of this invention is comparable with that of conventional shielded cable. The surface transfer impedance of the shielded cable of this invention in a range of a few hundred milliohms/meter over frequency is of 100 KHz to 1 GHz.

BRIEF DESCRIPTION OF THE DRAWING

A complete understanding of the present invention may be obtained by reference to the accompanying drawing when considered in conjunction with the subsequent detailed description, in which.

DETAILED DESCRIPTION OF THE INVENTION

Advanced technological uses for wire and cable have imposed many new requirements upon traditional wire and cable specifications and functions. In missile and aerospace environments, for example, the need for lighter weight cabling is directly related to aircraft performance and operating cost. Also, wiring is often required to meet stringent shielding specifications, since it is contemplated that the missile or aircraft will have to fly through radiation and electrical interference fields without comprising the on-board electronics.

At the present time, wire and cables are shielded electrically by braiding wire mesh around the primary wire core and insulation. This braided mesh is meant to prevent RFI and EMI disturbances from influencing the signals in the cable.

As advanced technology requirements impose greater stringency in shielding and weight specifications, these previously functional braided articles become unacceptable. Shielding leakages occur in these conventional cables by virtue of the looseness by which the wire mesh is braided, leaving holes in the shield web. In addition, the stiffness of the metal wire used in braiding makes it difficult to conform the mesh to the insulation core surfaces, leaving small gaps. Such gaps limit the frequency range in which the cable or wire can be operationally effective. While it may be possible to use finer wire mesh to resolve some of the abovementioned shielding problems, it is still necessary to contend with the lower weight requirements that these environments impose. The lower weight requirements cannot be practically met by using wire mesh braiding techniques.

The cable article of this invention has resolved the aforementioned problems by means of a shield material composed of fine mesh aramid yarns of fibers that have been coated with a thin layer of metal.

The high tensile strength and flexibility of the aramid fibers of this invention ensures that the fibers can be made thin without loss of structural integrity. The thinner the fiber, the tighter it can be braided or woven; and hence, the greater the shielding effectiveness. Also, the greater flexibility of the fiber mesh provides a greater conformity to the surface of the underlying insulation. Such improved conformity further improves the closeness and tightness of the mesh shield. This also contributes to a higher shielding frequency range capability. "Fibers", as used herein, includes continuous filaments and staple fibers; and "yarns", as used herein, includes yarns of such fibers.

Figure 1:
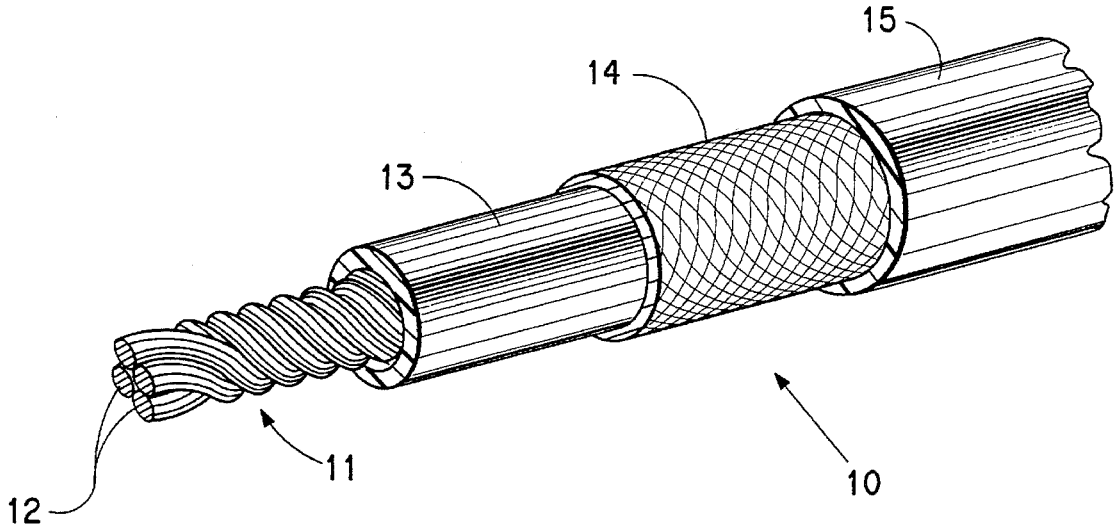
FIG. 1 is a schematic, cutaway, perspective view of the shielded cable article of this invention.

Now referring to FIG. 1, a typical shielded cable article 10 of this invention is illustrated in schematic, cutaway perspective view. The inner, electrically conductive core 11 of the cable 10 is composed of at least one metallic wire 12, usually of copper. Wire 12 can be straight, twisted or braided, as is conventionally known, and may be bare or individually insulated. Conductive core 11 is covered by at least one thin insulation layer 13, which insulation can be any suitable material as befits the utility and specifications sought to be met.

Insulation layer 13 is disposed over shielding layer 14 of this invention. The shielding layer 14 can be applied in one of two ways: a) as a thin layer of woven aramid yarn, or b) as a braided or served layer of aramid yarn. The fibers of the yarn or braid are coated with a metal, usually copper. The thickness of metal coating on each fiber is generally in a range of 0.05 to 5 microns. The aramid fibers are characterized by their high tensile strength and flexibility, thus allowing a tightly woven yarn or braided mesh.

Because of high tensile strength and flexibility of aramid fibers, very thin fibers can be used, thus permitting reduced weight and tighter weaving or braiding. The metal coated aramid fibers can be easily applied at a coverage of greater than 60% of the insulating layer and preferably at least 95% of the insulating layer.

The metallic coating can be applied by any of several processes. A process preferred for aramid fibers which are wholly poly(p-phenylene terephthalamide (PPD-T) as is the case in the examples, herein, is the electroless process disclosed in WO 90/00634, published Jan. 25, 1990. The metal can also be applied by a two-step process including commercially available electroless plating of a metal base coat followed by commercially available electrolytic plating of a metal over coat. Other aramid fibers can be plated by other means. For example, when the aramid fibers are a combination of PPD-T and polyvinyl pyrrolidone (PVP), the preferred process is the electroless process disclosed in U.S. Pat. No. 5,370,934. Other processes which could be utilized in coating metal on aramid fibers include electrostatic deposition, dielectric deposition, vapor deposition, and the like. At least one jacket layer 15 is generally disposed over shield layer 14. Jacket layer 15 can be any number of materials, as required or desired for the intended purposes and specifications designated for the final cable product.

DESCRIPTION OF THE PREFERRED EMBODIMENTS

Example 1

The aim of this example was to compare a coaxial cable of usual, commercial, construction with a cable in which the shielding is metal-plated aramid fiber. To that end, a standard RG58 A/U cable was identified as the comparison cable. RG58 A/U cable is made using 20 Gauge tinned copper conductive core, polyethylene insulation layer, tinned copper braid (95% coverage) shielding layer, and a polyvinyl chloride jacket layer.

Figure 2:
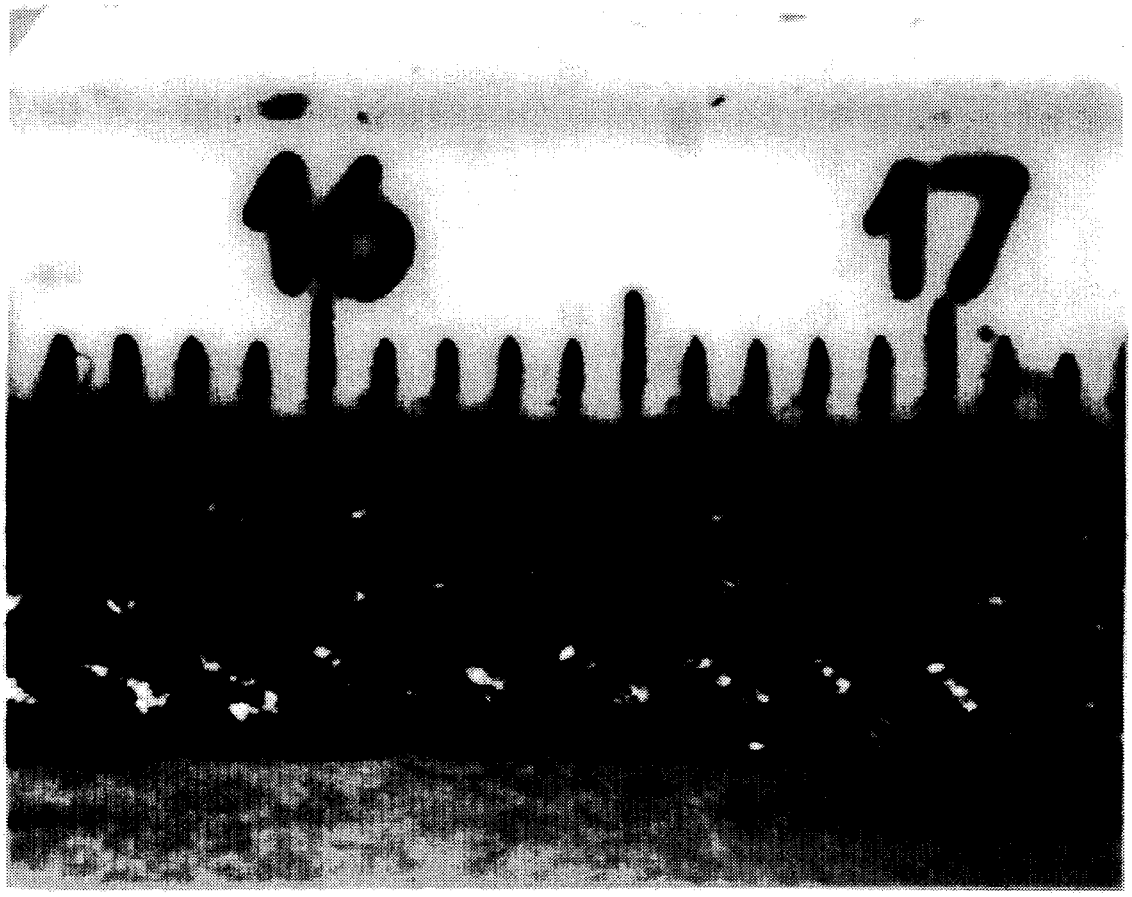
FIG. 2 is a photograph of a cable of this invention.

To make the cable of this invention, the jacket and the copper wire shielding was stripped from a 30 foot section of the comparison cable and a metal plated aramid yarn was braided onto the remaining cable structure. The braiding was conducted such that the insulation layer was approximately 100% covered. FIG. 2 is a photograph of the cable with the metal plated aramid braiding. The resulting cable with the braided aramid yarn was subsequently tested as described hereinafter. Similar results would be expected if the insulation layer were 96% covered.

The metal plated aramid yarn used in this example was a yarn of 1140 denier spun from continuous filaments of poly(p-phenylene terephthalamide) (PPD-T) of about 1.5 denier per filament in accordance with the teaching of U.S. Pat. No. 3,767,756 and sold by E. I. du Pont de Nemours and Company under the tradename of Kevlar 49. The metal on the yarn was nickel over copper. The copper was applied to individual filaments using a commercially available electroless copper plating system as is generally used for plating printed wiring boards, and the nickel was electrolytically plated on the copper using a commercially available electrolytic nickel plating system as is generally used in the manufacture of wiring boards and electronic connectors. The yarn contained about 70 weight percent metal based on the total weight of the plated yarn; and the thickness of the metal coating was estimated to be about 1 micron.

The resulting cable of this invention and the comparison cable were each tested for shielding effectiveness and transfer impedance. The test for shielding effectiveness was conducted by taking the difference in measured frequency responses between an unshielded reference cable and the shielded cable under test. The cable under test was strung between two brass boxes, each representing a piece of well shielded electronics equipment. The cable was terminated in a 50 ohm resistive load and was energized using a tracking generator in conjunction with a power amplifier. A spectrum analyzer was attached to a current probe to detect the resulting radiation current from the cable. With the spectrum analyzer on "maximum hold", the current probe was moved along the entire length of the cable to measure the maximum radiation current at all frequencies. A computer was used to read the data from the spectrum analyzer and calculate the cable shielding effectiveness. The unshielded reference cable was made from two parallel lengths of PVC insulated #20 AWG standard copper wire. Testing was conducted with the cables under test inside a shielded room. The test was on a cable 3 feet long with the following results:

| | Comparison (decibels) | This Invention (decibels) |
|---|---|---|
| A. 10–100 Mhz | 40–50 | 30–40 |
| B. 100-1000 Mhz | 30-40 | 25-35 |

Figure 3:
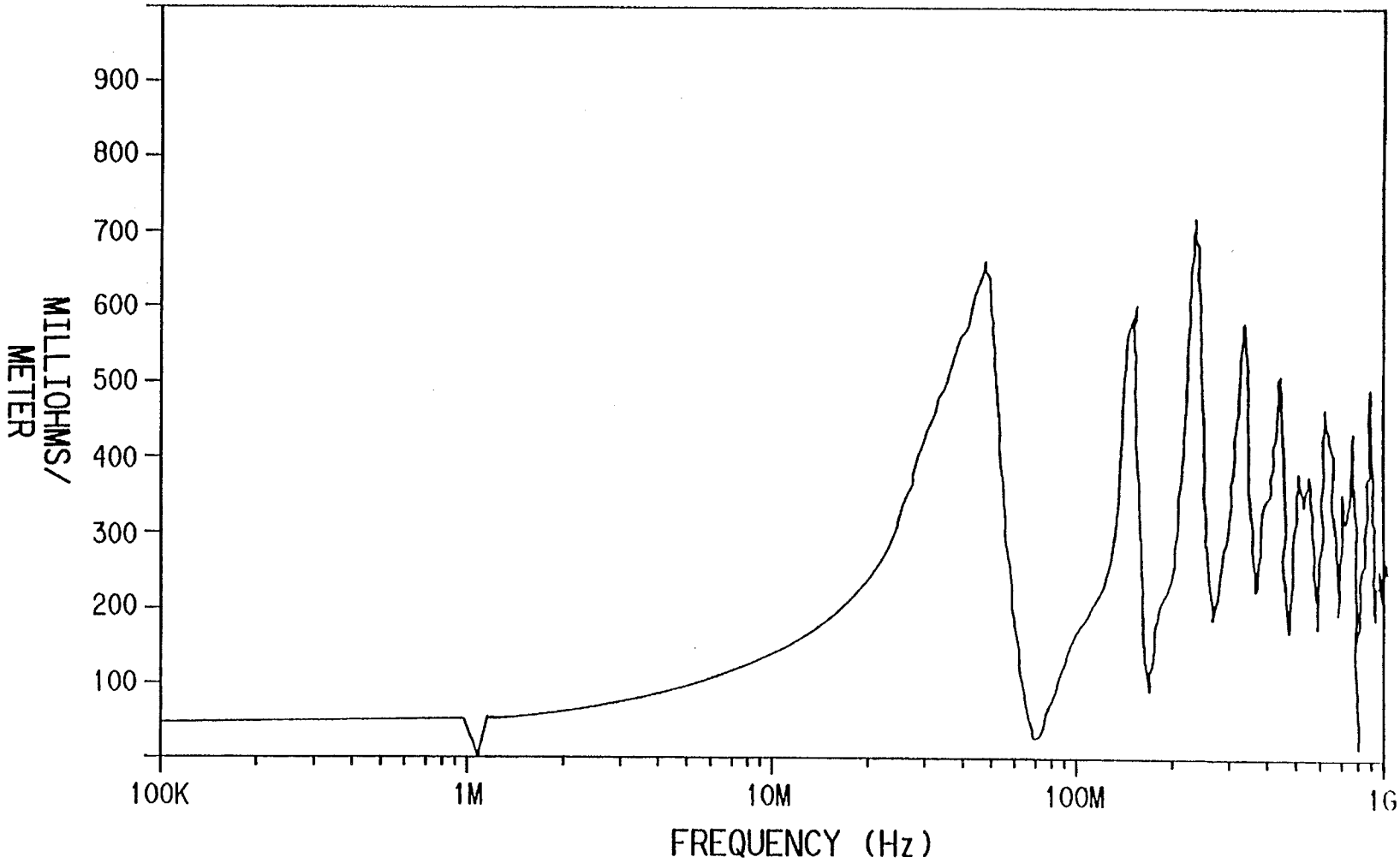
FIG. 3 is a graphical representation of the Transfer Impedance of the shielded cable article of this invention.
Figure 4:
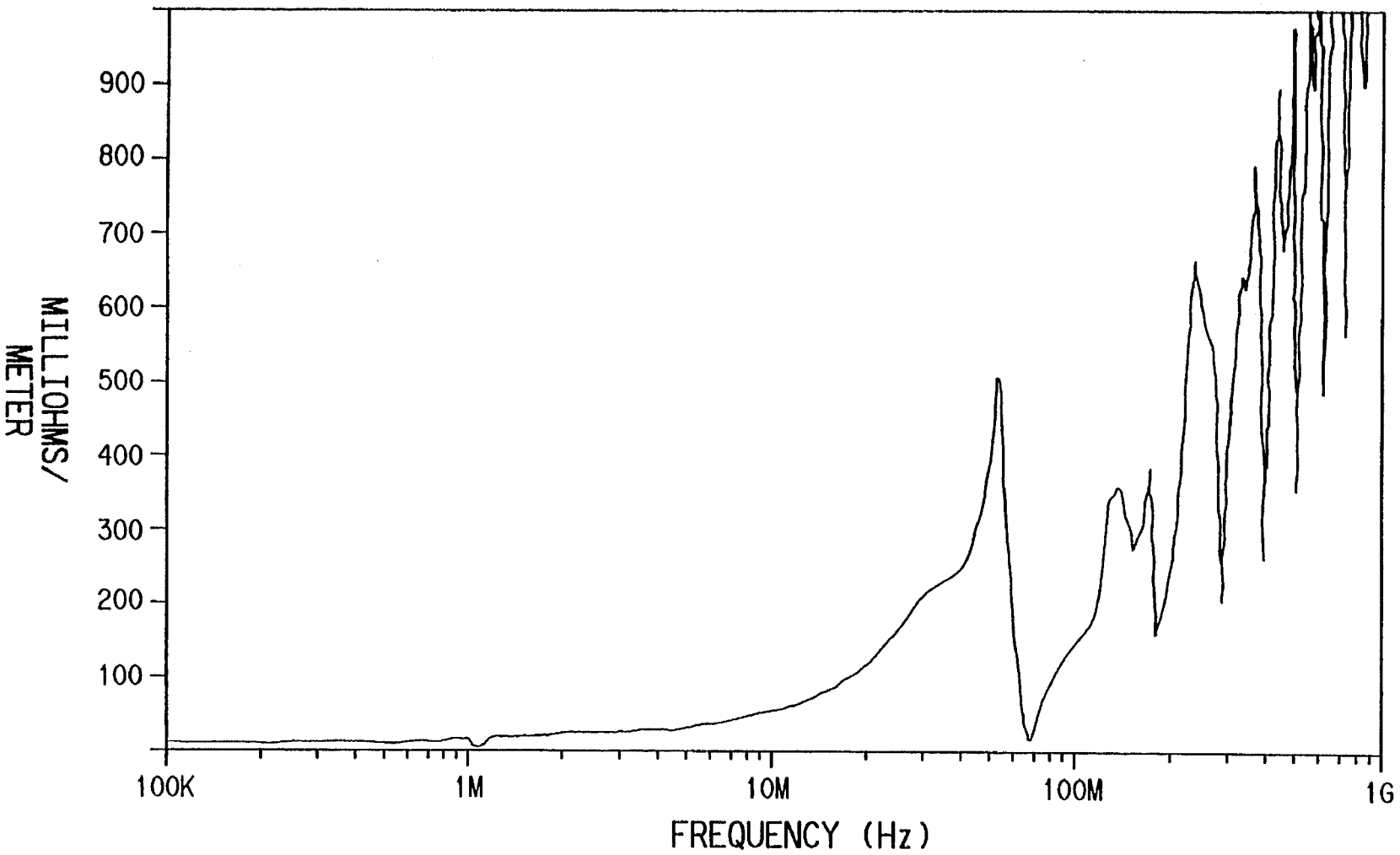
FIG. 4 is a graphical representation of the Transfer Impedance of a shielded cable of the prior art.

The Transfer Impedance for the cable of this invention from this example is shown in FIG. 3. The Transfer Impedance is less than 100 milliohms/meter from 100 KHz to about 10 MHz and is no higher than 750 milliohms/meter up to 1 GHz. The Transfer Impedance for the comparison cable is shown in FIG. 4. The Transfer Impedance is less than 100 milliohms/meter from 100 KHz to about 20 MHz and extends well beyond 1000 milliohms/meter at 1 GHz.

Attenuation and DC Resistance were, also, tested for the cable of this invention and for the comparison cable.

| | Comparison | This Invention |
|---|---|---|
| Attenuation (Decibels) | | |
| a) 100 MHz | 1.12 | 2.25 |
| b) 500 MHz | 2.97 | 9.55 |
| b) 1000 MHz | 4.70 | 18.3 |
| DC Resistance (Ohms/foot) | | |
| a) Conductor | 0.011 | 0.010 |
| b) Shield | 0.0042 | 0.043 |

The comparison cable weighed 27.05 pounds per 1000 feet while the cable of this invention weighed only 21.19 pounds per 1000 feet—an overall cable weight savings of 21.7%.

Example 2

The cable of this example utilizes an aramid yarn which is made from fibers spun from a combination of PPD-T and polyvinyl pyrrolidone and the fibers are plated in accordance with the teaching of U.S. Pat. No. 5,370,934. Using such metal plated aramid yarn, the metal plating exhibits improved adhesion to the yarn filaments.

This metal plated aramid yarn can be braided onto cables of this invention and the resulting cables exhibit the same good shielding qualities as were obtained in the previous example.

What is claimed is:

1. A cable article having shielding against EMI and RFI, comprising:

a conductive core member;

at least one layer of insulation disposed over said conductive core member;

a layer of shield material consisting essentially of metallic coated aramid fibers are braided into a mesh to provide a protective shield layer disposed over the insulated conductive core member, said braided mesh forming a shield layer that exceeds 96% coverage of said at least one layer of insulation and providing shielding effectiveness of 25–40 decibels across a frequency range of 10 to 1000 MHz.

2. A cable article having shielding against EMI and RFI, comprising:

a conductive core member;

at least one layer of insulation disposed over said conductive core member;

a layer of shield material consisting essentially of metallic coated aramid fibers are braided into a mesh to provide a protective shield layer disposed over the insulated conductive core member, said braided mesh forming a shield layer that exceeds 96% coverage of said at least one layer of insulation and providing shielding effectiveness of 25–40 decibels across a frequency range of 10 to 1000 MHz; and a jacket disposed over said protective shield layer comprising at least one layer of material.

3. A cable article having shielding against EMI and RFI, comprising:

a conductive core member;

at least one layer of insulation disposed over said conductive core member;

a layer of shield material consisting essentially of metallic coated aramid fibers are braided into a mesh to provide a protective shield layer disposed over the insulated conductive core member, said braided mesh forming a shield layer that exceeds 96% coverage of said at least one layer of insulation and providing characteristic impedance of $10^1$ to $10^3$ milliohms/meter across a frequency range of 100 KHz to 300 MHz and a jacket disposed over said protective shield layer comprising at least one layer of material.

* * * * *